United States Patent [19]

Chubb et al.

[11] Patent Number: 4,654,903

[45] Date of Patent: Apr. 7, 1987

[54] BEDSORE PREVENTION DEVICE IN AN INVALID BED ARRANGEMENT

[75] Inventors: Charles F. Chubb, Brookville; Joseph C. Vaiana, Melville, both of N.Y.

[73] Assignee: Nova Technologies, Inc., Hauppauge, N.Y.

[21] Appl. No.: 797,701

[22] Filed: Nov. 13, 1985

Related U.S. Application Data

[63] Continuation-in-part of Ser. No. 731,533, May 7, 1985.

[51] Int. Cl.[4] ..... A61G 7/10

[52] U.S. Cl. ..... 5/61; 5/108; 5/509

[58] Field of Search ..... 5/61, 62, 108, 109, 5/431, 465, 509, 11, 63–66

[56] References Cited

U.S. PATENT DOCUMENTS

| | | | |
|---|---|---|---|
| 984,324 | 2/1911 | Von Below | 5/465 |
| 1,677,218 | 7/1928 | Shand | 5/61 |
| 3,013,281 | 12/1961 | Steiner | 5/62 |
| 3,058,126 | 10/1962 | Fleming et al. | 5/465 |
| 3,405,900 | 10/1968 | Robinson | 5/62 |
| 3,541,618 | 11/1970 | Johnson et al. | 5/109 |
| 4,114,209 | 9/1978 | Sandlin | 5/62 |
| 4,214,326 | 7/1980 | Spann | 5/431 |
| 4,490,867 | 1/1985 | Gabrielsson | 5/61 |

FOREIGN PATENT DOCUMENTS

| | | | |
|---|---|---|---|
| 2410414 | 9/1975 | Fed. Rep. of Germany | 5/61 |
| 233298 | 10/1944 | Switzerland | 5/62 |

*Primary Examiner*—Gary L. Smith
*Assistant Examiner*—Michael F. Trettel
*Attorney, Agent, or Firm*—Max Fogiel

[57] ABSTRACT

An arrangement for the prevention of bedsores on invalids confined to bed, in which the bed can be tilted toward either side for shifting the weight distribution of a patient to promote circulation of the blood and thereby prevent the development of bedsores. A reversible motor drives a ball nut through a worm screw so that motion of the ball nut in one direction raises one side of the bed frame, and motion in an opposite direction raises the opposite side of the bed frame.

21 Claims, 7 Drawing Figures

BEDSORE PREVENTION DEVICE IN AN INVALID BED ARRANGEMENT

The present application is a continuation-in-part of the parent application Ser. No. 731,533 filed May 7, 1985.

BACKGROUND OF THE INVENTION

The process of transferring an invalid person from a hospital bed to a wheelchair, to a commode, or to a bathtub in a hospital, nursing home, or home, or assisting such a person in such a transfer, often involves more than one person, is labor-intensive and can be costly. The task frequently requires considerable strength and is occasionally a source of injury to the invalid person or attendant. Further, the task of periodically moving or turning a patient to prevent decubitus ulcers (bedsores) is arduous and fatiguing. These problems often are the major factors that cause a person to be hospitalized or moved to a nursing home, rather than being cared for at home. They also increase the cost of caring for persons in hospitals and nursing homes.

Accordingly, it is the object of the present application to provide novel arrangements of parts or attachments which can be added and attached to existing or new beds (including home or hospital types) or designed into new beds. These arrangements are intended to significantly assist in the following:

(A) the transfer of a person or patient from one bed to a reclining wheelchair or other surface;

(B) the transfer of a person or patient to and from a "tub" arrangement for bathing of the patient;

(C) the transfer of a person or patient to and from a pad surface designed to automatically vary the pressure or reduce the pressure on a person's skin to prevent decubitus ulcers;

(D) the removal and replacement of soiled bed sheets.

The principal object of this present invention is to provide improvements to implement the lateral tilting of the bed surface to shift the weight distribution of a patient in order to promote circulation of the blood and thereby prevent the development of bedsores. This improvement is to be compatible with the normal functions of a hospital bed and with arrangements or attachments to provide the functions A, B, and C above.

A widely used method of preventing bedsores is to periodically change the position of a recumbent patient (e.g. every two hours) to improve blood circulation to parts of the body which are under pressure from body weight. This is a burdensome manual task, particularly in the case of a heavy patient, and it frequently is the cause of back injuries to a nurse or attendant.

An easier method of changing a patient's position is to tilt the surface on which the patient rests so as to shift his position and weight and thereby vary the pressure distribution across his body. Various methods have been used for this purpose, including nets which support the patient above the mattress and which are wound up on rollers on either side of the bed to tilt the patient from one side to the other, and special beds in which the center part of the mattress can be tilted side to side. Most or all of these arrangements interfere to some degree with the normal care of a person in a hospital bed, including the free articulation of the mattress to raise the knees and back of a patient. They also, in general, are not compatible with equipment to transport a person over the surface of a bed on a moving sheet, as described in the parent application.

These disadvantages are overcome in this present invention, in which the entire bed is tilted to shift a patient's position and weight distribution for bedsore protection.

Additional objects and advantages of the present invention will become more evident from the following description of specific embodiments when read in conjunction with the accompanying drawings.

DESCRIPTION OF THE PREFERRED EMBODIMENTS

Figure 1:
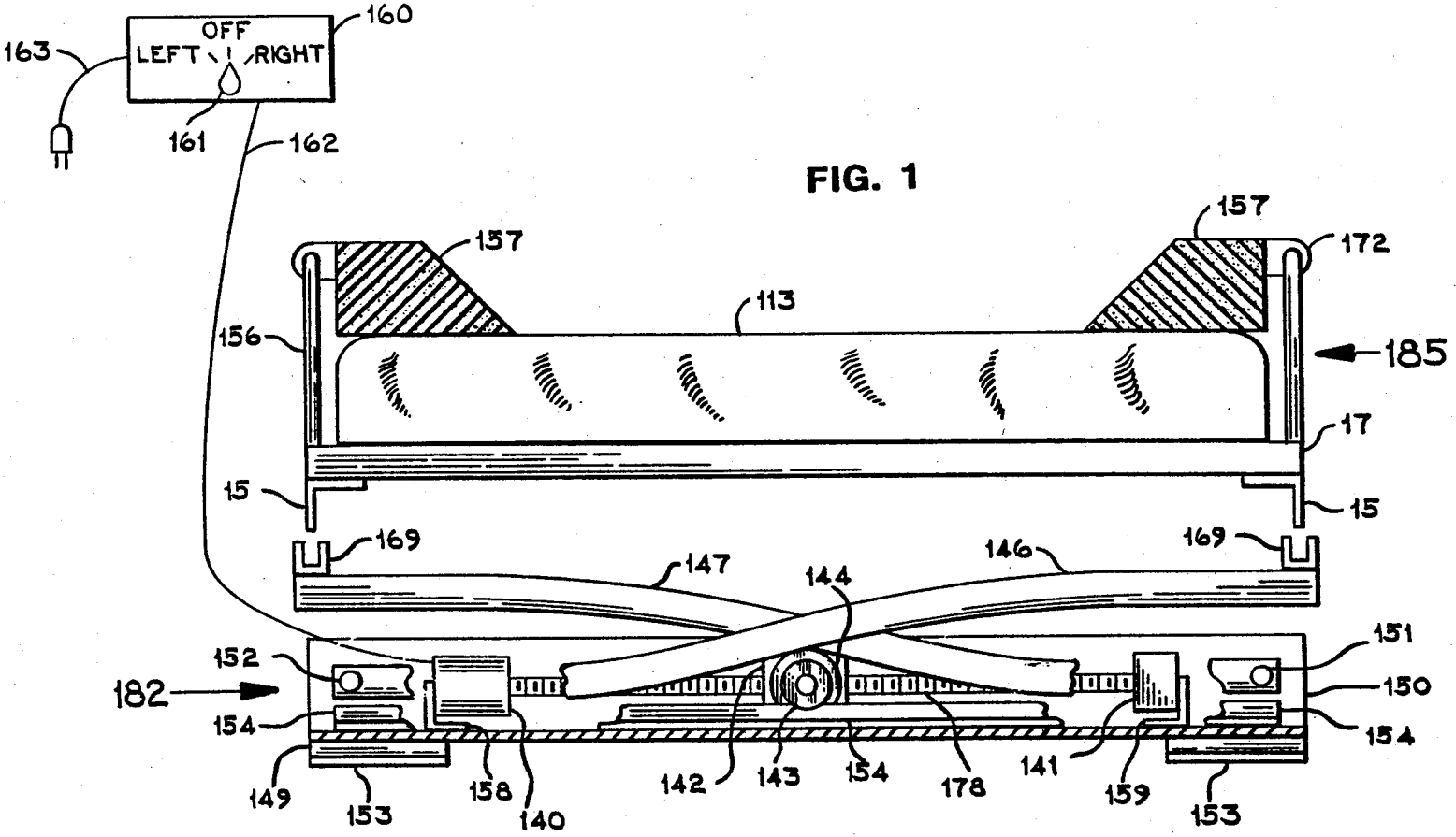
FIG. 1 is a partial sectional schematic of an end view of a bed equipped with a tilting mechanism which lifts and supports one or the other side of the bed frame.
Figure 2:
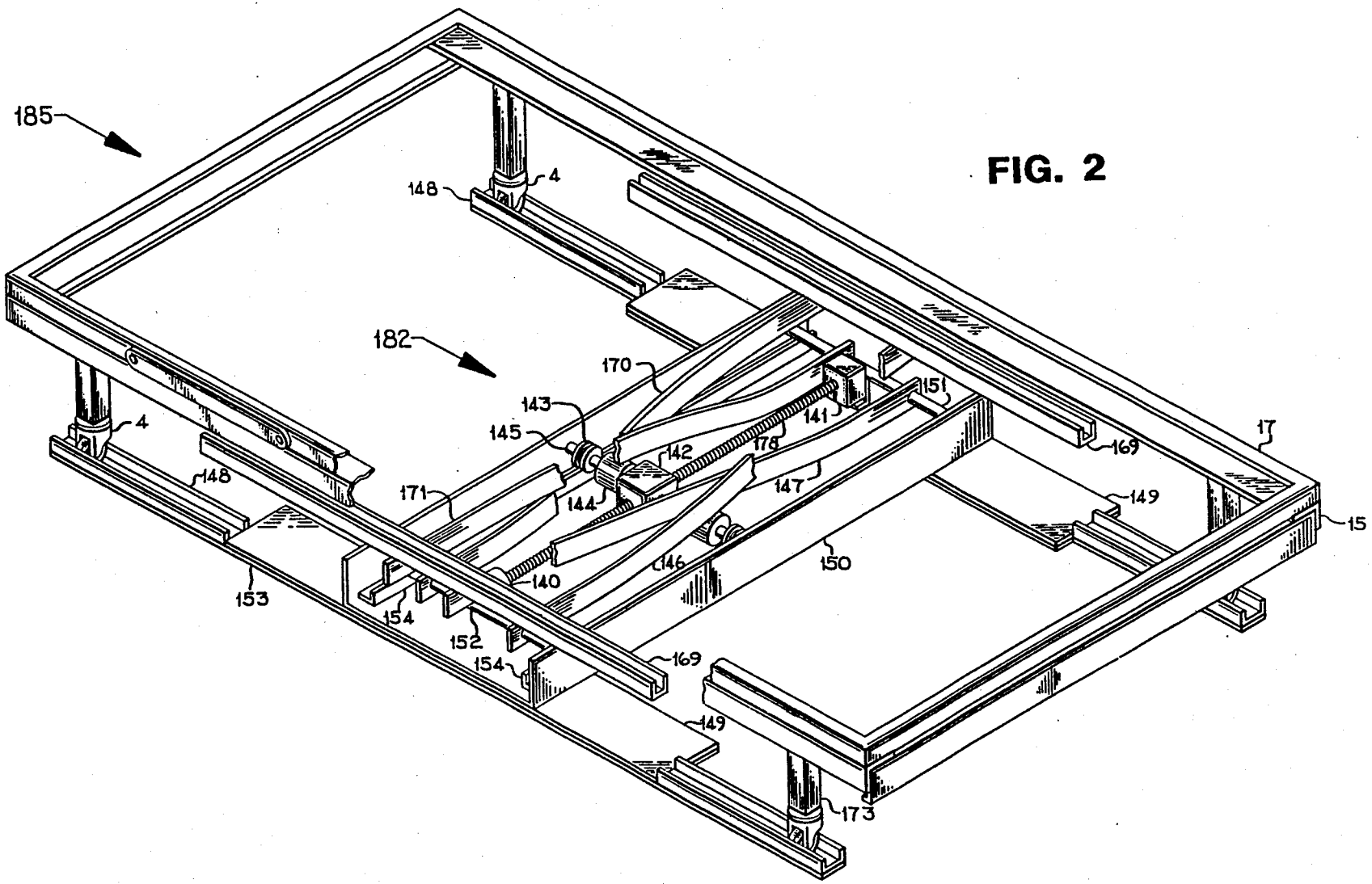
FIG. 2 is a partial perspective view of the tilting mechanism and frame.

FIG. 1 is a partial sectional schematic end view of a typical home or hospital type bed 185 with a tilting mechanism 182 to tilt the entire bed from side to side. FIG. 2 is a partial perspective view showing the tilting mechanism 182 and bed frame. For simplicity, the bed legs 173 are depicted as for a home bed, but they are intended to represent also those for a hospital bed. The bed elevating mechanism and the articulation mechanism to raise a patient's back and legs are not shown, except for the movable (articulating) frame 17. The bed in FIG. 1 is tilted by raising and supporting one side of fixed frame 15 while the other side of the bed is resting on its wheels 4, which are captured in channel 148. When the bed is not tilted, it is supported on its legs and wheels (not shown in FIG. 1).

The tilting mechanism consists of a motor drive 140 comprising a reversible motor, gear box, and slip clutch assembly of the type which is widely used on hospital beds. This drives worm screw 178 and thereby ball nut 142 to which is attached a roller shaft 145 with a guide roller 143 and lift roller 144 on each side. The guide rollers ride on the guide roller tracks 154, and the lift rollers 144 ride against the lower portions of lift arms 146, 147, 170 and 171. When ball nut 142 is driven toward the right side of the bed, two lift arms 147 and 171 raise U channel 169 which engages lifts and supports frame member 15 on the bed, thereby tilting the bed to the right. The wheels 4 at the other side of the bed are held by channels 148, welded or otherwise attached to floor plates 149 on each side of the tilting mechanism. "U" channel 169 and opposite "U" channel 148, respectively, support the bed frame 15 and opposite legs 173, both laterally and vertically, so as to prevent excessive bending loads on the bed legs when the bed is tilted.

The lift arms 146 and 170 pivot about shaft 152, and lift arms 147 and 171 pivot about shaft 151. These pivot shafts are approximately in line with the wheels of the bed and are securely mounted to the cross channel 150 to which are attached floor plates 149 for stability and rubber isolator pads 153. Also attached to the cross channel, are ball screw motor 140 through bracket 158, shaft bearing block 141 through bracket 159, and guide roller tracks 154.

Before starting the tilting operation, bolsters 157 are placed along each side of mattress 113 to support and cradle the patient. The bolsters are removably attached by loops 172 with VELCRO or other fastening devices to side rails 156, which are bolted or otherwise attached to frame 17, and which support the bolsters, patient and mattress when the bed is tilted.

The motor 140 is connected through cable 162 to a control box 160, on which is mounted a momentary spring-return switch whereby the motor can be activated to drive in either direction by apparatus well known to those skilled in the art. Cable 163 connects to the required power source, normally 115 v 60 Hz.

The control box 160 may be mounted in any convenient location or may be hand-held. Adjustable limit stops (not shown) and/or limit switches (not shown) may be provided to adjust the maximum tilt angle of the bed. In addition, an automatic timer with relay circuits, in addition to the manual control switch, can be employed to automatically change the tilt of the bed at programmed intervals, e.g. every two hours—the interval which is typically used for bedsore prevention. However, manual control is preferred for reasons of patient safety.

Figure 3:
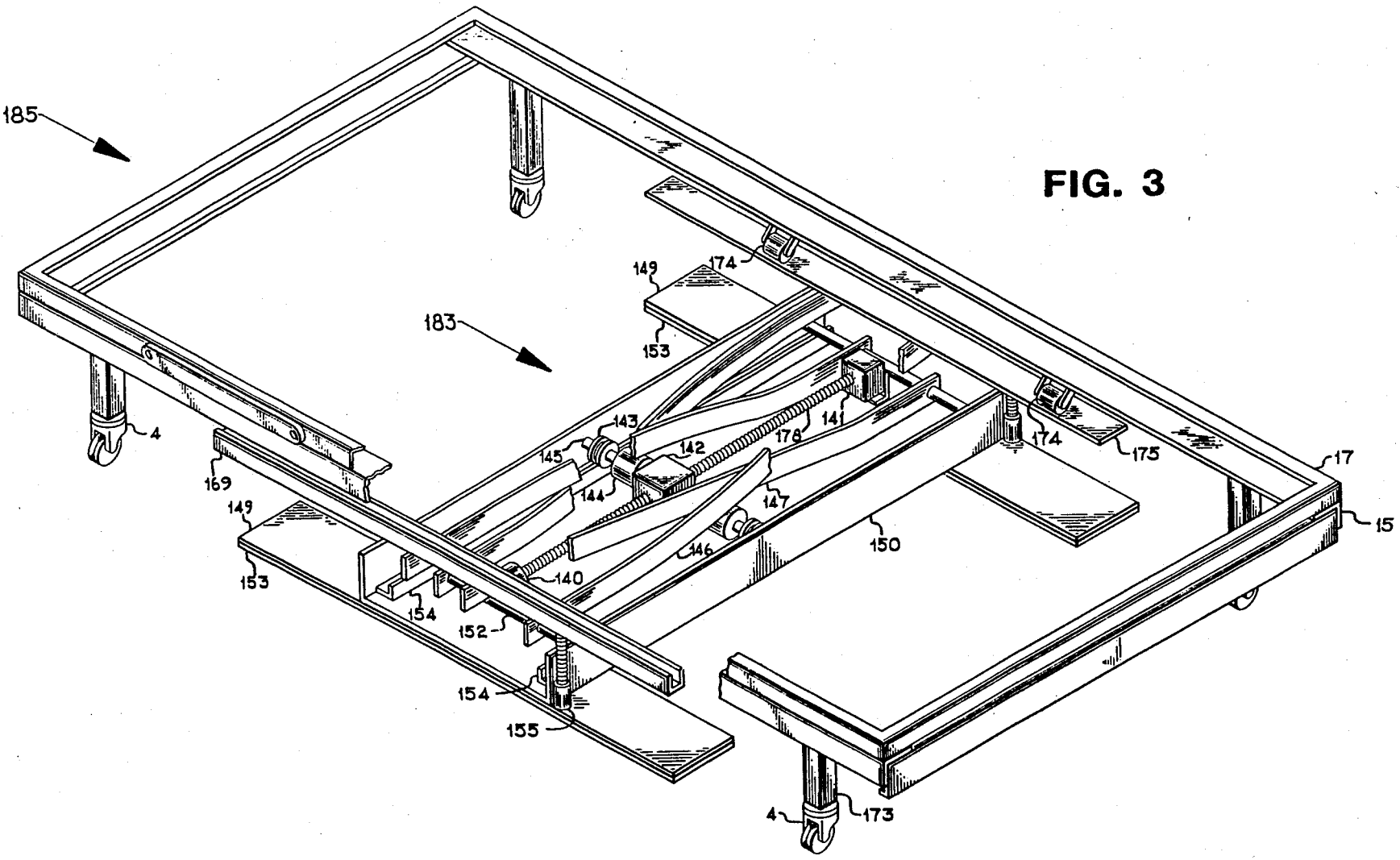
FIG. 3 is similar to FIG. 2 except that both sides of the bed frame are supported simultaneously by the tilting mechanism.

FIG. 3 is a partial-perspective view of a tilting mechanism which is very similar to FIG. 2 except that it supports and tilts the bed frame with all bed legs lifted off the floor. During normal use, the bed is elevated to a selected height, and adjustable lift stops 155 are set, so that bed frame 15 is enclosed by channel 169 but not lifted. Channel 169 thereby holds the bed 185 in position for tilting. Alternatively, the bed can be held in position by chocks under the wheels. In preparation for tilting the bed, which in this case is a hospital bed with an elevating mechanism, the bed is lowered so that bed frame 15 is engaged by channel 160 and rollers 174 rest on support plate 175, which is fastened to lifting arms 146 and 170. The elevating drive is then lowered a little more to lift the bed feet off the floor. The bed tilting mechanism then operates just as in FIG. 1, except that the frame 15 is supported in channel 160 on one side of the bed, and rests on rollers 174 on plate 175 on the other side of the bed. The rollers allow for motion between the plate 175 and bed frame 15 due to the displacement between the lift arm pivot axes 151 and 152 and the bottom edges of bed frame 15.

Figure 4:
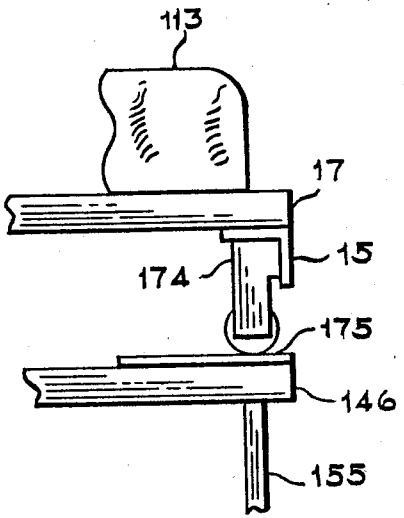
FIG. 4 is a partial sectional end view of the bed and tilting mechanism of FIG. 3.

FIG. 4 is a partial sectional end view of the bed and elevating mechanism showing roller 174 and support plate 175.

Figure 5:
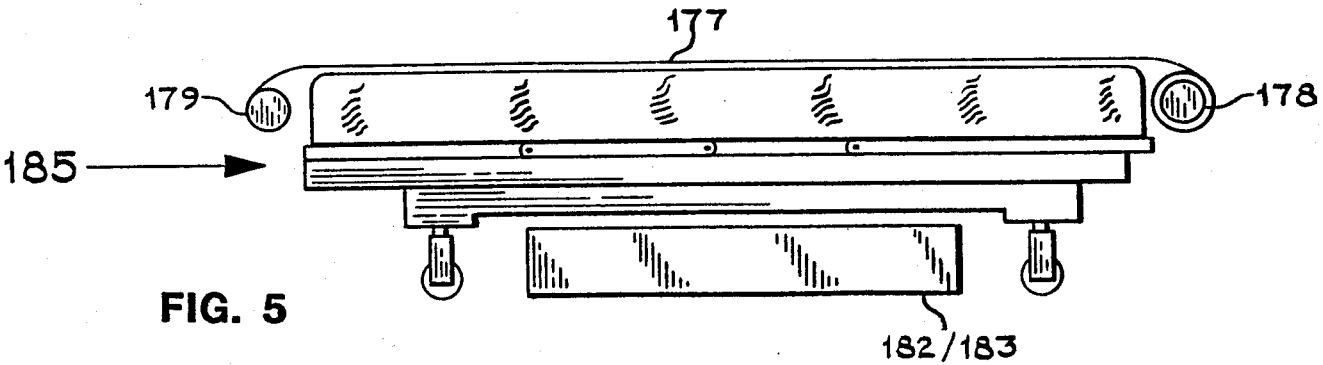
FIG. 5 is a schematic side view of a bed equipped with a tilting mechanism and with a roller-driven transport sheet.

FIG. 5 is a schematic side or end view of a bed equipped with a roller-driven transport sheet and roller drive means (not shown). The tilting mechanism 182/183 represents that in FIG. 2 or FIG. 3. The transport sheet 177 can be moved across the bed by being wound up in roller assembly 179 and unwound from roller assembly 178, or vice-versa. The transport roller assemblies, which may vary greatly in design, are located at opposite ends or sides of the bed, and are not used during and do not interfere with, the bed tilting operation.

Figure 6:
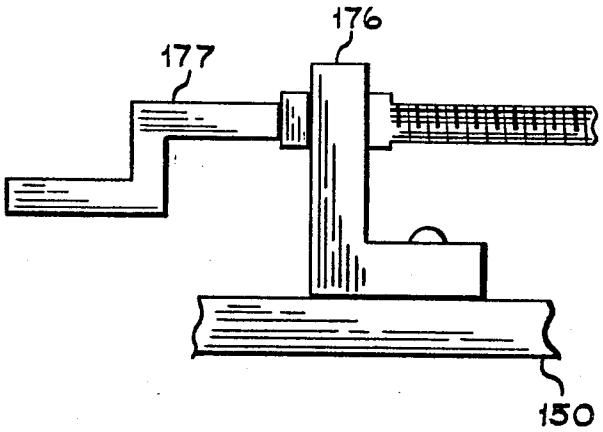
FIG. 6 is a partial elevation view showing an alternate hand crank drive.

FIG. 6 is a partial elevation view showing a hand crank 177 which couples to worm screw 178, supported from member 150 by bracket and bearing 178, and which can be used in place of motor drive 140 in FIGS. 2 and 3 in other embodiments of this invention.

Figure 7:
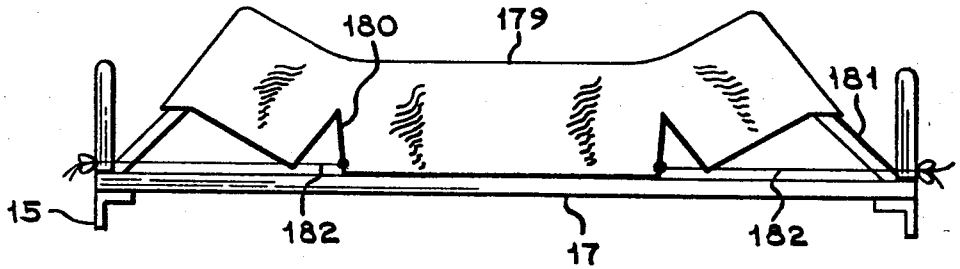
FIG. 7 is a partial elevation sectional view showing an alternate patient support arrangement.

FIG. 7 is a partial elevation sectional view showing an alternate method of supporting a patient during the tilting operation. Mattress 179 is constructed with slots 180 which allow it to bend as shown. Mattress 179 is held centered on the bed by flexible strips of cloth with ties 182 which fasten to side rail 156 or frame member 17 or 15. The sides of mattress 179 are held up by supports 181 which fit into fabric pockets on the mattress or are otherwise fastened to the lower side edges of mattress 179. The lower ends of supports 181 rest on the side rails or are otherwise supported on bedframe 17 or 15.

I claim:

1. A bedsore prevention arrangement comprising a bed with two opposite sides and including a mattress, a bed frame and legs; tilt means for tilting the bed toward either one of said two sides; patient support means for supporting a reclining patient when the bed is tilted; said tilting means comprising reversible motor drive means coupled to a worm screw; a ball nut driven by said worm screw; first roller means and track means for guiding and restraining said ball nut; second roller means connected to said ball nut and supporting lever arm members actuated by said ball nut so that motion of said ball nut in one direction moves said supporting lever arm members for raising one side of said bed frame and motion of said ball nut in an opposite direction moves said supporting lever arm members for raising an opposite side of said bed frame.

2. A bedsore prevention arrangement as defined in claim 1, including support members attached to said lever arm members and having vertical projections engaging said bed frame for providing lateral support to said bed frame on both sides of the bed.

3. A bedsore prevention arrangement as defined in claim 2, including attached members constraining and preventing lateral motion of the bed legs relative to said tilt means.

4. A bedsore prevention arrangement as defined in claim 1, including support members with vertical projections engaging said bed frame on one side of said bed frame for providing lateral support to said frame; roller means on the other side of said bed frame to permit lateral motion between said bed frame and support thereof.

5. A bedsore prevention arrangement comprising a bed with two sides and mattress, a bed frame and legs; tilt means for tilting the bed toward either one of said two sides; patient support means for supporting a reclining patient when the bed is tilted; said tilting means comprising hand crank drive means coupled to a worm screw; a ball nut driven by said worm screw; first roller means and track means for guiding and restraining said ball nut; second roller means connected to said ball nut and supporting lever arm members actuated by said ball nut so that motion of said ball nut in one direction moves said supporting lever arm members for raising one side of said bed frame and motion of said ball nut in an opposite direction moves said supporting lever arm members for raising an opposite side of said bed frame.

6. A bedsore prevention arrangement comprising a bed with two opposite sides and mattress, a bed frame and legs; tilt means for tilting the bed toward either one of said two sides; patient support means for suppoting a reclining patient when the bed is tilted; said tilting means comprising hand crank drive means coupled to a worm screw; a ball nut driven by said worm screw; first roller means and track means for guiding and restraining said ball nut; second roller means connected to said ball nut and supporting lever arm members actuated by said ball nut so that motion of said ball nut in one direction moves said supporting lever arm members for raising one side of said bed frame and motion of said ball nut in an opposite direction moves said supporting lever arm members for raising an opposite side of said bed frame; support members attached to said lever arm members and having vertical projections engaging said bed frame for providing lateral support to said bed frame on both sides of the bed.

7. A bedsore preventing arrangement comprising a bed with two opposite sides and mattress, a bed frame and legs; tilt means for tilting the bed toward either one of said two sides; patient support means for supporting a reclining patient when the bed is tilted; said tilting means comprising hand crank drive means coupled to a worm screw; a ball nut driven by said worm screw; first roller means and track means for guiding and restraining said ball nut; second roller means connected to said ball nut and supporting lever arm members actuated by said ball nut so that motion of said ball nut in one direction moves said supporting lever arm members for raising one side of said bed frame and motion of said ball nut in an opposite direction moves said supporting lever arm members for raising an opposite side of said bed frame; support members attached to said lever arm members and having projections engaging one side of said bed frame for providing lateral support to said frame; roller means on the opposite side of said bed frame to permit lateral motion between said bed frame and support thereof.

8. A bedsore prevention arrangement comprising a bed with two opposite sides and including a mattress, a bed frame and legs; tilt means with support frame for tilting the bed toward either one of said two sides; patient support means for supporting a reclining patient when the bed is tilted; said tilt means comprising motor drive means coupled so as to produce a reciprocating and adjustable linear motion to a member; means for guiding and restraining said member; lift roller means connected to said member; said lift roller means supporting a pair of right lever arm members having right ends supporting the right side of said bed frame and left ends pivoted below the left side of the bed frame from a tilt means support frame resting on a floor; said lift roller means also supporting a pair of left lever arm members oppositely disposed from said right lever arm members; said right and left pairs of lever arm members being so inclined that leftward motion of said lift roller means raises the right lever arm members and thereby the right side of the bed frame, rightward motion of said lift roller means raising the left lever arm members and thereby the left side of the bed frame.

9. A bedsore prevention arrangement as defined in claim 8, including support members attached to said lever arm members and having vertical projections about said bed frame for providing lateral support to said bed frame on both sides of the bed; and attached members constraining and preventing lateral motion of the bed legs relative to said tilt means.

10. A bedsore prevention arrangement as defined in claim 8, including said support members with vertical projections engaging said bed frame on one side of said bed frame for providing lateral support to said frame; and roller means on the other side of said bed frame to permit lateral motion between said bed frame and support thereof.

11. A bedsore prevention arrangement as defined in claim 8, wherein said patient support means comprises side rails attached to said bed frame; removable bolsters extending along a side and resting on the mattress; and attachment means to secure said bolsters to the bed.

12. A bedsore prevention arrangement as defined in claim 8, wherein said patient support means comprises a mattress with slots, said mattress being bendable for elevating side edges of the mattress; and removable members for supporting the elevated mattress edges.

13. A bedsore prevention arrangement as defined in claim 8, wherein said tilt means comprises a hand crank drive coupled so as to produce a reciprocating and adjustable linear motion.

14. A bedsore prevention arrangement as defined in claim 8, including support members attached to said lever arm members and having vertical projections about said bed frame for providing lateral support to said bed frame on both sides of the bed.

15. A bedsore prevention arrangement as defined in claim 8, including support members attached to said lever arm members and having projections engaging one side of said bed frame for providing lateral support to said frame; and roller means on the opposite side of said bed frame to permit lateral motion between said bed frame and support thereof.

16. A bedsore prevention arrangement as defined in claim 8, including transport means with rollers at opposite ends of the bed; a flexible sheet extending over said mattress between said rollers; roller drive means for winding said sheet from a roller on the opposite bed end for pulling said sheet across the mattress surface so as to transport a person lying on the sheet to and beyond the end of the bed; said rollers being positioned entirely below the top surface of the mattress for providing smooth passage of a person off the bed and onto a support placed end to end with the bed.

17. A bedsore prevention arrangement as defined in claim 8, including transport means with rollers at opposite side of the bed; a flexible sheet extending over said mattress between said rollers; roller drive means for winding said sheet up on one roller on one bed side and unwinding said sheet from a roller on the opposite bed side for pulling said sheet across the mattress surface so as to transport a person lying on the sheet to and beyond the side of the bed, said rollers being positioned entirely below the top surface of the mattress for providing smooth passage of a person off the bed and onto a support placed side to side with the bed.

18. A bedsore prevention arrangement comprising a bed with two opposite sides and including a mattress, a bed frame and legs; tilt means with support frame for tilting the bed toward either one of said two sides; patient support means for supporting a reclining patient when the bed is tilted; said tilting means comprising reversible motor drive means coupled to a worm screw; a ball nut driven by said worm screw; guidance roller means and track means for guiding and restraining said ball nut; lift roller means connected to said ball nut; said lift roller means supporting a pair of right lever arm members having right ends supporting the right side of said bed frame and left ends pivoted below the left side of the bed frame from said tilt means support frame resting on a floor; said lift roller means also supporting a pair of left lever arm members oppositely disposed from said right lever arm members; said right and left pairs of lever arm members being so inclined that leftward motion of said lift rollers means raises the right lever arm members and thereby the right side of the bed frame, rightward motion of said lift roller means raising the left lever arm members and thereby the left side of the bed frame.

19. A bedsore prevention arrangement comprising a bed with two sides and mattress, a bed frame and legs; tilt means with support frame for tilting the bed toward either one of said two sides; patient support means for supporting a reclining patient when the bed is tilted; said tilting means comprising hand crank drive means coupled to a worm screw; a ball nut driven by said worm screw; first roller means and track means for guiding and restraining said ball nut; guidance roller means and track means for guiding and restraining said ball nut; lift roller means connected to said ball nut; said lift roller means supporting a pair of right lever arm members having right ends supporting the right side of said bed frame and left ends pivoted below the left side of the bed frame from said tilt means support frame resting on a floor; said lift roller means also supporting a pair of left lever arm members oppositely disposed from said right lever arm members; said right and left pairs of lever arm members being so inclined that leftward motion of said lift rollers means raises the right lever arm members and thereby the right side of the bed frame, rightward motion of said lift roller means raising the left lever arm members and thereby the left side of the bed frame.

20. A bedsore prevention arrangement comprising a bed with two opposite sides and mattress, a bed frame and legs; tilt means with support frame for tilting the bed toward either one of said two sides; patient support means for supporting a reclining patient when the bed is tilted; said tilting means comprising hand crank drive means coupled to a worm screw; a ball nut driven by said worm screw; guidance roller means and track means for guiding and restraining said ball nut; lift roller means connected to said ball nut; said lift roller means supporting a pair of right lever arm members having right ends supporting the right side of said bed frame and left ends pivoted below the left side of the bed frame from said tilt means support frame resting on a floor; said lift roller means also supporting a pair of left lever arm members oppositely disposed from said right lever arm members; said right and left pairs of lever arm members being so inclined that leftward motion of said lift roller means raises the right lever arm members and thereby the right side of the bed frame, rightward motion of said lift roller means raising the left lever arm members and thereby the left side of the bed frame; and support members attached to said lever arm members and having vertical projections about said bed frame for providing lateral support to said bed frame on both sides of the bed.

21. A bedsore prevention arrangement comprising a bed with two opposite sides and mattress, a bed frame and legs; tilt means with support frame for tilting the bed toward either one of said two sides; patient support means for supporting a reclining patient when the bed is tilted; said tilting means comprising hand crank drive means coupled to a worm screw; a ball nut driven by said worm screw; guidance roller means and track means for guiding and restraining said ball nut; lift roller means connected to said ball nut; said lift roller means supporting a pair of right lever arm members having right ends supporting the right side of said bed frame and left ends pivoted below the left side of the bed frame from said tilt means support frame resting on a floor; said lift roller means also supporting a pair of left lever arm members oppositely disposed from said right lever arm members; said right and left pairs of lever arm members being so inclined that leftward motion of said lift rollers means raises the right lever arm members and thereby the right side of the bed frame, rightward motion of said lift roller means raising the left lever arm members and thereby the left side of the bed frame; support members attached to said lever arm members and having projections engaging one side of said bed frame for providing lateral support to said frame; and roller means on the opposite side of said bed frame to permit lateral motion between said bed frame and support thereof.

* * * * *